US007124696B2

(12) United States Patent
Lobur

(10) Patent No.: US 7,124,696 B2
(45) Date of Patent: Oct. 24, 2006

(54) PORTABLE CARPET BINDING MACHINE

(75) Inventor: Terry J. Lobur, Seven Hills, OH (US)

(73) Assignee: Bag Sewing Machine Service, Inc., Seven Hills, OH (US)

( * ) Notice: Subject to any disclaimer, the term of this patent is extended or adjusted under 35 U.S.C. 154(b) by 90 days.

(21) Appl. No.: 11/040,764

(22) Filed: Jan. 21, 2005

(65) Prior Publication Data

US 2006/0162633 A1 Jul. 27, 2006

(51) Int. Cl.
*D05B 23/00* (2006.01)

(52) U.S. Cl. ..... 112/7

(58) Field of Classification Search ..... 112/7, 112/137, 169, 80.03, 322, 199, 318, 448, 112/459, 460

See application file for complete search history.

(56) References Cited

U.S. PATENT DOCUMENTS 4,062,307 A * 12/1977 Michelberger ..... 112/7
4,947,771 A * 8/1990 Miyachi et al. ..... 112/141
4,958,580 A * 9/1990 Asaba et al. ..... 112/314
5,067,424 A * 11/1991 Ishikawa et al. ..... 112/307
5,209,171 A 5/1993 Anderson
5,331,910 A * 7/1994 Mukai et al. ..... 112/470.32
5,660,128 A 8/1997 Wokeck
5,732,640 A 3/1998 Mizusaki et al.
5,782,190 A * 7/1998 Porter et al. ..... 112/176
5,875,723 A * 3/1999 Lobur ..... 112/7
6,024,036 A * 2/2000 Miyachi et al. ..... 112/470.01
6,055,918 A 5/2000 Hajjar et al.
6,082,279 A * 7/2000 Ito et al. ..... 112/314
6,283,054 B1 * 9/2001 Engle ..... 112/152
6,688,246 B1 * 2/2004 Sadasue et al. ..... 112/127

OTHER PUBLICATIONS

1) *Union Special Stitch Formation Type 401* (*booklet*), Union Special Corp. 1976.
2) *Parts Chart for Consew Model 224, 224R-I, 225, 226R-I* (*chart*) Consew (date of publication unknown).
3) *Portable Bag Closer Model NP-8*. Newlong Machine Works, Ltd., Ctg. No. FK-0101-NL-NLN (1990).
4) *Portable Bag Closer Model NP-311*. Newlong Machine Works, Ltd., Ctg. No. C4005-E-N (1986).

(Continued)

*Primary Examiner*—Gary L. Welch
*Assistant Examiner*—Nathan Durham
(74) *Attorney, Agent, or Firm*—Watts Hoffmann Co., LPA

(57) ABSTRACT

A portable carpet binding machine comprising a housing defining an interior region, a drive mechanism supported by the housing and at least partially disposed in the interior region, a prime mover operatively coupled to the drive mechanism for providing motive power to the drive mechanism, a sewing assembly driven via the drive mechanism for sewing a strip of material to a piece of carpet. The portable carpet binding machine includes a carpet feeding assembly including a feed driver mechanism and a coacting puller mechanism operating in substantially synchronous movement to linearly feed the piece of carpet relative to the sewing assembly. The feed driver mechanism includes a feed-dog driven via the drive mechanism that intermittently engages the bottom of the piece of carpet to thereby advance the piece of carpet forward. The coacting puller mechanism includes first and second feed rollers driven via the drive mechanism. The first feed roller engages the top of the piece of carpet and the second feed roller engages the bottom of the piece of carpet. The first and second feed rollers pull the piece of carpet forward substantially simultaneously with respect to the advancement by the feed-dog of the feed driver mechanism.

37 Claims, 7 Drawing Sheets

OTHER PUBLICATIONS

5) *Portable Bag Closer Model NP-7A*. Newlong Machine Works, Ltd.Ctg. No. C4006-E-N (1985).

6) *Newlong Model NP-311 Portable Bag Closure Instruction Manual/Parts List. No. 4*, Newlong Machine Works, Ltd. Ctg. No. P2017K 94-12-300F (1992).

7) *Union Special Industrial Sewing Machines, Class 51300*, Union Special Machine Co., Ctg. No. 249 (Jun. 1967).

8) *Union Special Industrial Sewing Machines, Style 51800BA*, Union Special Machine Co., Ctg. No. 104R (1961).

9) *Everything for Carpet Binding, Fringing, Serging, Carving, Cutting, Beveling and Custom Carpet Applications*, N-C Carpet Binding & Equipment Corp., Ctg. No. 50M91 (date of publication unknown).

10) *N-C Master Finish by Munsinger*, N-C Carpet Binder & Equipment Corp., one-page flyer (date of publication unknown).

11) *Sisal Binder Model 81200-S*, N-C Carpet Binder & Equipment Corp., one-page flyer (date of publication unknown).

12) *N-C Carpet Cove Base Cutters*, N-C Carpet Binder & Equipment Corp., two-page flyer (date of publication unknown).

13) *Union Special Industrial Sewing Machines, Class 56100*, Union Special Machine Co., Ctg. No. 130 M (1965).

* cited by examiner

PORTABLE CARPET BINDING MACHINE

FIELD OF THE INVENTION

The present invention relates to sewing machines and, more particularly, to sewing machines adapted to sew binding material onto carpet edges.

BACKGROUND OF THE INVENTION

Carpet binding machines are used to sew binding material, or tape, to the top and bottom of a piece of carpet to bind the edge of the carpet. Oftentimes, in a wall-to-wall carpet installation, a four or six inch strip of contrasting carpet will be used as coving instead of wood or rubber cove molding. In such an installation, the upper edge of the carpet cove needs binding material sewn thereon to present a finished appearance and so that the edge does not unravel. The stitch utilized by most carpet binding machines is the federal stitch type 401 chain stitch because of its streamlined appearance and effective binding capability.

Carpet binding machines are generally classified as being portable or stationary. Stationary machines are heavy, often weighing between 55 and 65 pounds. The weight of such machines forces them to be used at a single location, for example, in a carpet installer's warehouse, to sew binding material onto a carpet edge. While such machines tend to be durable, their lack of portability limits their usefulness in situations where the carpeting cannot be precut into appropriate length pieces for the job and bound in the installer's warehouse. Also, such stationary machines tend to be costly compared to their portable counterparts.

Portable carpet binding machines have the advantage of being capable of being transported and used at installation sites by installers. They do not require the carpeting to be precut and prebound as with a stationary machine and are lower in cost than stationary machines. However, the durability and reliability of most prior art portable carpet binding machines has been unsatisfactory.

Portable carpet binding machines are manufactured by modifying a standard household sewing machine. While such sewing machines are suitable for sewing clothes and similar light fabrics, subjecting such machines to the rigors of sewing carpeting characterized by heavy backing material and a plush pile results in an undesirable rate of skipped or otherwise malformed stitches, carpet feed problems, or even sewing machine breakdowns.

A skipped or malformed stitch can be corrected at the installation site. However, because such problems recur with frequency, oftentimes taking the time to restitch a piece of carpet can result in substantial delays and inconvenience.

A skipped stitch may occur in a type 401 stitch sewing cycle, for example, if the needle loop is not properly formed and the looper misses the opening of the needle loop as a result. Because portable carpet binding machines typically use a plastic needle thread, there is a greater tendency for the needle thread to flex in an unpredictable manner and, therefore, create unpredictable sewing results. Oftentimes, a single skipped stitch will cause the succeeding stitch to be missed because the previously improperly formed needle loop generates additional slack in the needle thread making it difficult to form the next needle loop. A series of missed stitches can cause an unsightly gap in the stitching of the binding material and a risk of the carpet edge unraveling.

A malformed stitch may occur, for example, if there is too much slack in the needle thread or looper thread. A household sewing machine incorporates thread take-up mechanisms to remove slack in the threads. These thread take-up mechanisms, however, are not designed to be used in a portable carpet binding machine. Some prior art portable carpet binding machines that modify such household sewing machines fail to adequately modify the thread take-up mechanism, which, in turn, can cause such malformed stitches.

A malformed stitch can also occur when the piece of carpet is not fed properly through the sewing machine. Portable carpet binding machines that are made from a modified household sewing machine utilize what is known in the art as a presser foot and feed-dog to feed the carpet. It has been found that this single feed assembly is unsatisfactory for feeding a piece of carpet. Furthermore, the rigors of carpet binding may subject components of the machine to undue stress and cause excessive wear or failure in the components.

Since most carpet installers can only afford a single carpet binding machine, a breakdown of the machine requires the installer to quit working on the installation, take the machine to a repair shop, procure needed repairs and then return to the installation site to finish the job. The downtime of a portable carpet binding machine, whether due to restitching or repairing, results in downtime of the installer in addition to the expense of repair of the machine. Since most installers are paid by the job, downtime has a direct impact on the number of jobs completed by the installer and his or her net income.

Because of the thickness and stiffness of the carpet being bound, another problem with prior art carpet binding machines is their tendency to pull or angle away from the carpet edge while the machine moves along the carpet. This is typically caused by an insufficient carpet feeding assembly and results in poor appearance of the resulting bound carpet edge. When the binding machine angles away from the carpet edge as is moves along the carpet, the stitching and binding material are angled with respect to the edge of the carpet. Moreover, instead of the binding material being snugly pulled and stitched around the edge of the carpet, excess binding material gathers loosely around the carpet edge providing an unsightly appearance and poor durability.

One portable carpet binding machine that represented a significant advance in the art was the machine disclosed in U.S. Pat. No. 5,875,723 to Lobur. The '723 patent is incorporated herein in its entirety by reference. The '723 patent disclosed a portable carpet binding machine that included a novel carpet feeding assembly with a feed driver mechanism and coacting puller mechanism acting in synchronization to pull the carpet through the sewing mechanism.

While the carpet binding machine disclosed in the '723 patent proved to be a lightweight, yet rugged and durable machine, certain improvements were desirable to further improve the feed drive mechanism such that even the heaviest and thickest carpet would be pulled linearly through the sewing mechanism and the machine would not tend to pull away from the edge of the carpet.

What is needed is a portable carpet binding machine that is adapted to sewing light or heavy pile carpeting and that includes a carpet feeding assembly that feeds the carpet linearly through a sewing assembly and that moves the machine uniformly along an edge of the carpet. What is further desired is an upper direct drive mechanism within close proximity to the existing puller mechanism, wherein the upper direct drive mechanism is capable of vertical movement to compensate for varying thicknesses in the carpet material. It is desirable to accomplish such vertical movement of the upper drive mechanism through a direct connection with a minimal number of parts, such as universal joints, linkages, and bushings, which increase the cost of the machine and decrease efficiency. What is also needed is a portable carpet binding machine that is lightweight and that is more durable and reliable than prior art portable carpet binding machines. Such a machine must also be easy to manufacture and repair and be competitively priced with prior art portable carpet binding machines.

SUMMARY OF THE INVENTION

The present invention is directed to a portable carpet binding machine that is adapted to bind binding material, or tape, to the edge of light or heavy carpeting. The portable carpet binding machine is durable, lightweight (weighing about 18 pounds) and is easy to manufacture using known manufacturing techniques. Its design also facilitates easy repair of worn out or damaged working components of the machine.

The portable carpet binding machine includes a housing defining an interior region. The housing supports two rolls of thread and a coil of binding material. A distal end of the first roll of thread is threaded through a needle of the sewing assembly while a distal end of the second roll of thread is threaded through a looper of the sewing assembly. The binding material is sewn to the top and bottom to bind the edge of the piece of carpet using a chain stitch known as a federal stitch type 401 double locked chain stitch to those skilled in the art.

The housing is supported on rollers permitting the machine to move with respect to a stationary piece of carpet to be bound. Alternately, if the piece of carpet to be bound is relatively small, the carpet binding machine may be held stationary and the carpet fed through the machine.

Extending from the housing is also a handle to aid in positioning the machine as desired and carrying the machine between locations at an installation site. The housing supports a finger trigger switch for activating the drive mechanism. Advantageously, the trigger switch can be locked into an "on" position and a microswitch is provided for actuating the machine when carpet is fed into the sewing assembly.

A drive mechanism is supported by the housing and at least partially disposed in the interior region. A prime mover is operatively coupled to the drive mechanism for providing motive power to the drive mechanism. In the preferred embodiment, the prime mover comprises an AC 60 watt series motor. In the preferred embodiment, a potentiometer is operative to vary the speed of the prime mover and, consequently, the speed of the drive mechanism.

The drive mechanism drives a sewing assembly. The sewing assembly is operative to sew a strip of material to a piece of carpet. The sewing assembly includes a binder guide, a sewing needle and a looper. The binder guide operates to fold the strip of material around an edge portion of the piece of carpet. A first piece of thread is threaded through an aperture of the needle and a second piece of thread is threaded through an aperture of the looper. The sewing assembly, when driven by the drive mechanism, is operative to stitch the strip of material to opposite sides of the edge portion of the piece of carpet using the first and second pieces of thread.

The present invention also includes a carpet feeding assembly. The carpet feeding assembly includes a feed driver mechanism and a coacting puller mechanism that operate in substantially synchronous movement to linearly feed the piece of carpet relative to the sewing assembly. The feed driver mechanism includes a feed-dog that is driven by the drive mechanism and that intermittently engages the bottom of the piece of carpet, which, in turn, advances the piece of carpet forward.

The coacting puller mechanism includes a first feed roller disposed above the feed-dog so that the piece of carpet is engaged between the feed-dog and the first feed roller when the carpet is advanced. The first feed roller is biased by a spring to provide a downward force against the top of the piece of carpet. The second feed roller is driven by the drive mechanism to pull the piece of carpet forward substantially simultaneously with respect to advancement of the piece of carpet by the feed-dog.

The coacting puller mechanism further includes a second feed roller located downstream of the feed-dog. Like the first feed roller, the second feed roller is driven by the drive mechanism. The second feed roller engages the bottom of the piece of carpet and pulls the piece of carpet forward substantially simultaneously with respect to the advancement by the feed-dog and the first feed roller.

The coacting puller further includes a presser roller, which is disposed above the second driven roller. The presser roller provides a downward force opposite the second feed roller so that the piece of carpet is engaged therebetween. A spring biases the presser roller downwardly.

The first and second feed rollers also comprise a helical profile on their outer surface. The helical profile advantageously produces a force that pulls the carpet inward relative to the sewing assembly. The helical profile increases the quality of the stitch, as well reduces the effort required by the operator of the carpet binding machine in maintaining a linear feed of the carpet into the machine.

The first feed roller and feed-dog are driven by a single piece drive mechanism that comprises an integral first and second eccentric cams for advancing the carpet through the sewing assembly. Such integral configuration help reduce breakdowns in the equipment while increasing the quality of the stitching. The single piece drive mechanism further comprises a third eccentric cam that is removably attached to the shaft that is used to drive the second feed roller.

Additional features will become apparent and a fuller understanding obtained by reading the following detailed description made in connection with the accompanying drawings.

DETAILED DESCRIPTION

Figure 1:
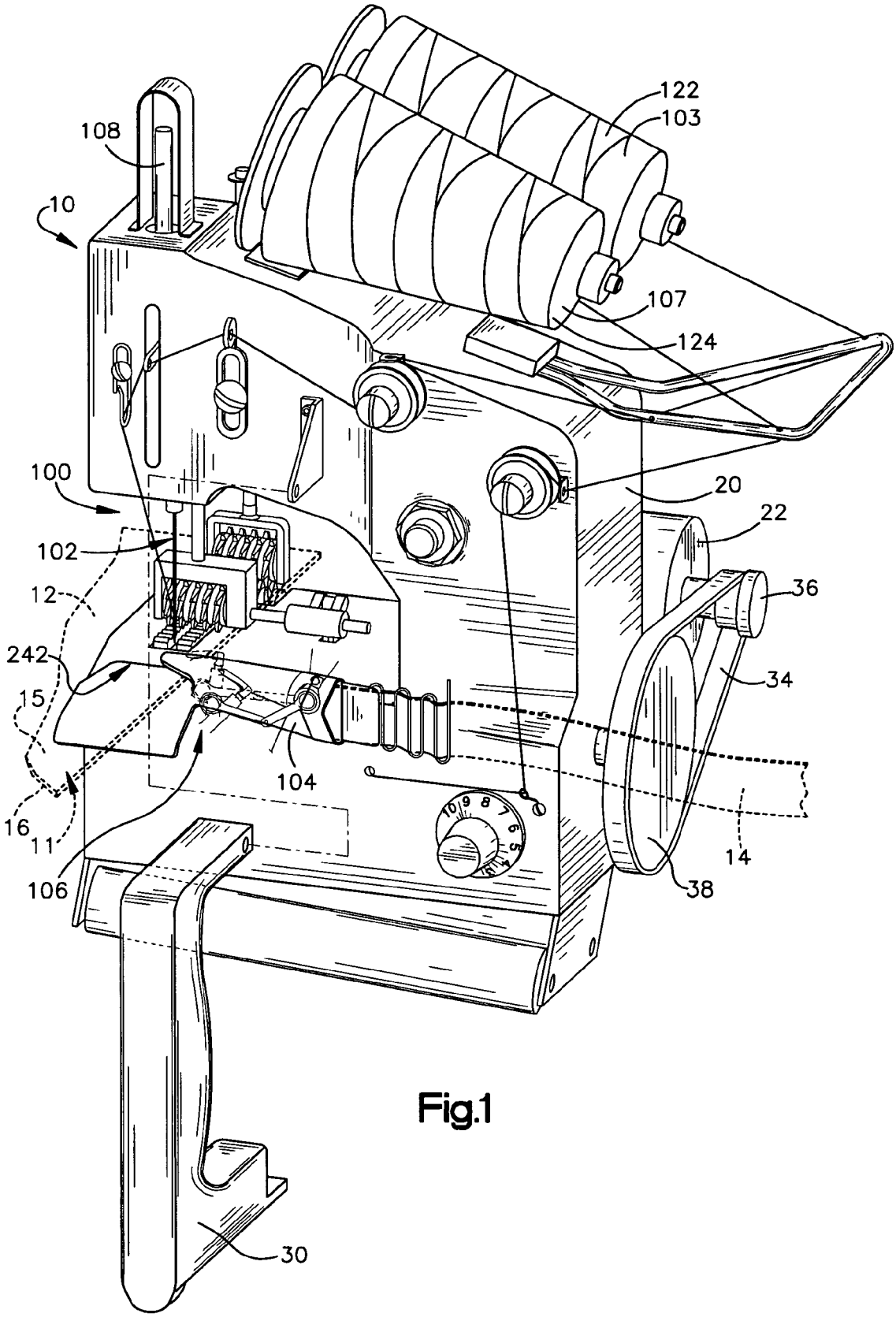
FIG. 1 is a perspective view with a cut-away portion of the portable carpet binding machine of the present invention shown sewing binding material to a strip of carpeting.

A portable carpet-binding machine of the present invention is shown generally at 10 in FIG. 1. To describe the features of the present invention the illustrated embodiment shows a Newlong Model NP-3II portable bag-closing machine with modifications thereto. However, it should be understood by those skilled in the art that the present invention is adaptable to any type of sewing machine.

The machine 10 is shown binding a cut edge 11 of a piece of carpet 12. The binding process involves sewing a binding material 14 to the top 15 and bottom 16 of the piece of carpet 12 so that the binding material 14 overlies the cut edge 11 of the piece of carpet 12. Typically, the binding material 14 is ⅞ inch wide but can vary from ¾ inch to 3 inches. The carpeting 12 is a strip four to six inches in width. Such a carpet strip 12 is used for coving in a wall-to-wall carpet installation, but it should be understood that the machine 10 will function to sew binding material to a peripheral edge of any size piece of carpet 12.

The machine 10 includes a housing 20 and an AC motor 22 attached to and extending from the housing 20. A drive belt 34 is driven by a pulley shaft 36 of the motor 22. The housing 20 supports a driven pulley 38 and a handle 30 used to position the machine 10 and carry the machine 10 between job locations.

Figure 3:
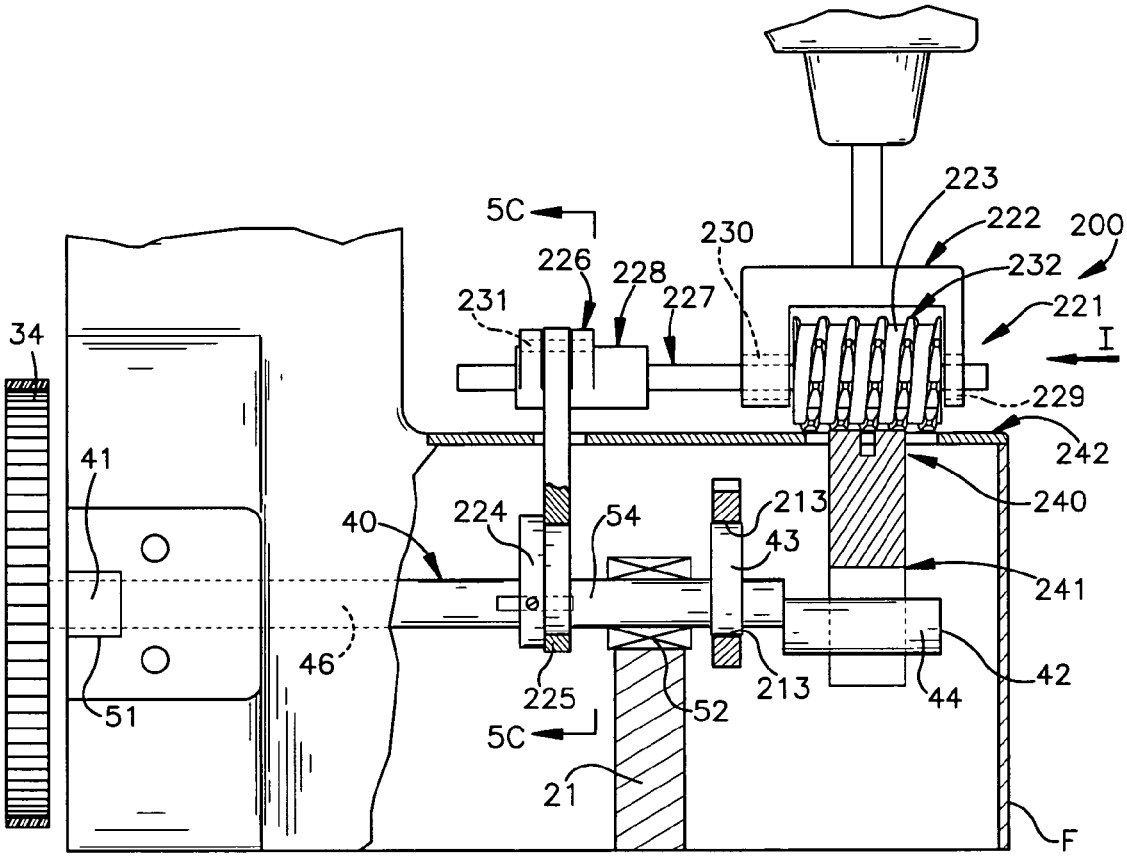
FIG. 3 is a left side view, partly in section and partly in elevation, of the portable carpet binding machine of FIG. 1 showing a drive mechanism for an upper feed roller
Figure 4:
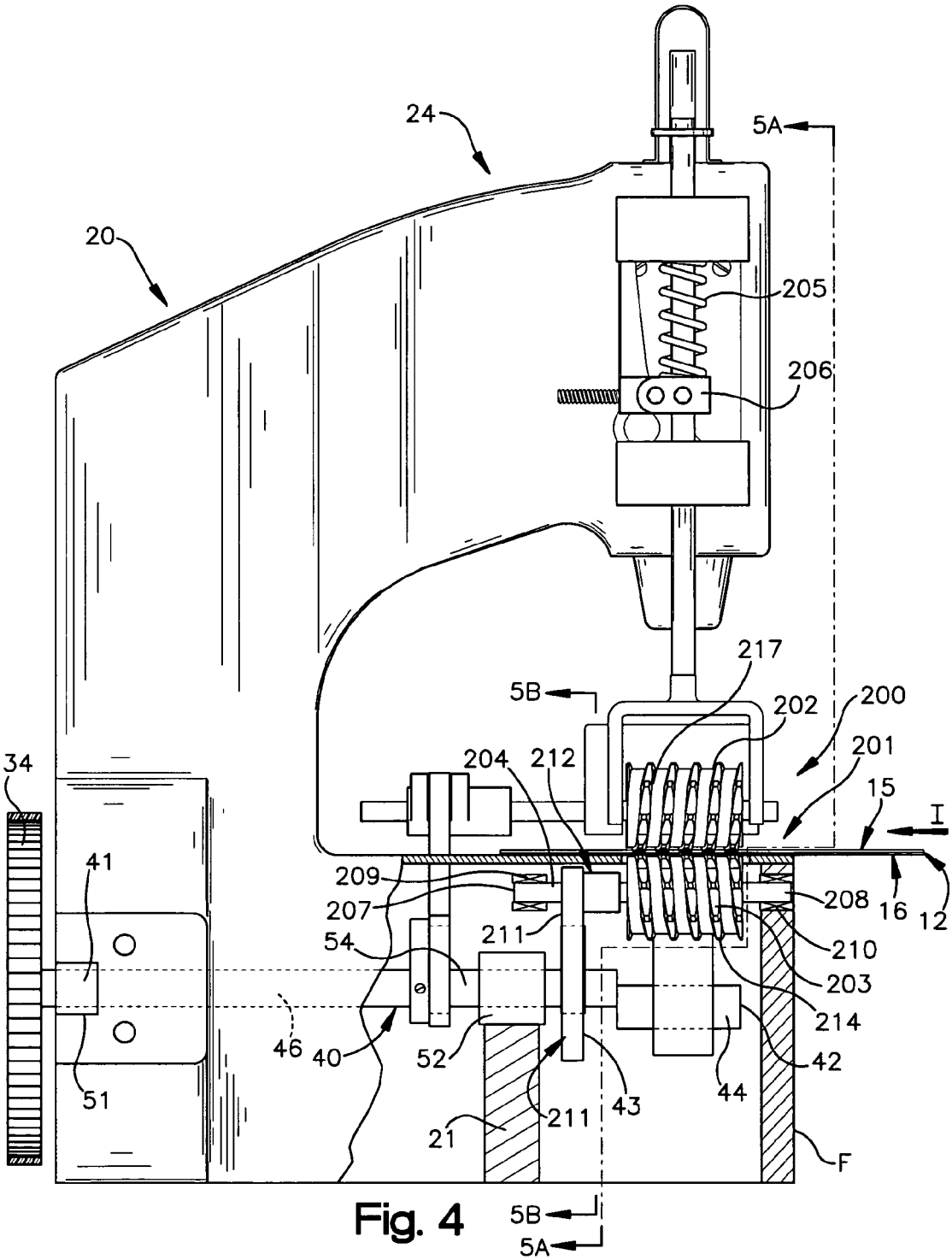
FIG. 4 is a left side view, partly in section and partly in elevation, of the portable carpet binding machine of FIG. 1 showing a drive mechanism for a lower feed roller.

The housing 20 supports a drive mechanism 40 that includes the driven pulley 38 and a single piece drive shaft 46 affixed to the pulley 38. As can be seen in FIGS. 3 and 4, the drive shaft 46 is supported near its front 41 and rear 42 by bushings 51, 52. The single piece drive mechanism 40 is driven by the motor 22 (shown in FIG. 1) via drive belt 34 and pulley 38 and provides motive power to a sewing assembly generally designated as reference character 100 (FIG. 1), and a carpet feeding assembly generally designated as reference character 200 (FIGS. 3 and 4).

Figure 6:
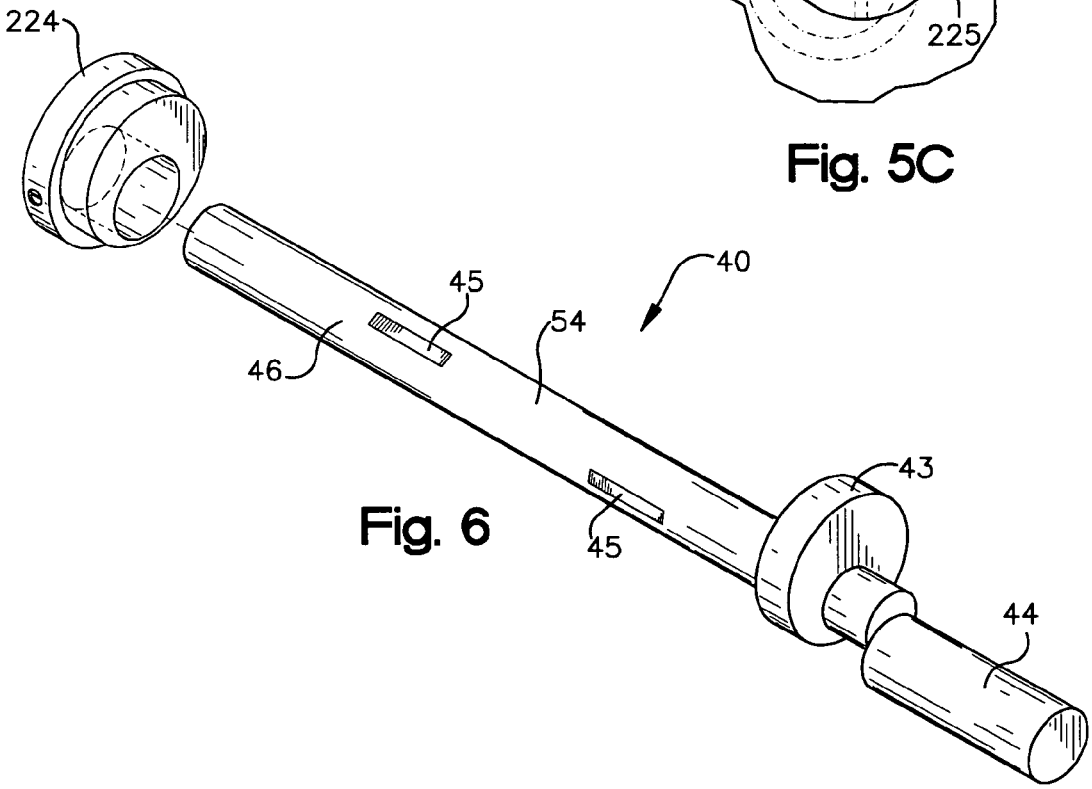
FIG. 6 is a perspective view of a single piece drive shaft of the portable carpet binding machine of FIG. 1 that drives a feed-dog and upper and lower feed rollers.

A detailed drawing of the single piece drive shaft 46 is shown in FIG. 6. The drive shaft 46 preferably is turned from a single piece of bar stock and formed integrally on the shaft is a first eccentric cam 43 and second eccentric cam 44. Because of the position of the first and second cams 43, 44 being exterior to or outside of the region between the bushings 51, 52, the drive shaft 46 of the present invention advantageously is a one piece drive shaft. By contrast, in prior art drive shafts, at least one of the cams was in the region between the shaft bushings and, therefore, in order to remove the drive mechanism 40 from housing 20, the cam between the bushings had to be capable of being disengaged from the shaft.

Because the design of the present invention locates first eccentric cam 43 to the outside of bushing 52, that is, toward a front F of the machine 10, a single piece shaft drive mechanism can be used. The single piece shaft drive mechanism is advantageous in several respects. First, single piece shaft drive mechanism avoids timing problems often seen in the prior art because the single piece design will not have cams held in place by set screws which are prone to becoming loosened over time with the vibration of the machine. Second, space saving resulting from the relocation of the first eccentric cam 43 outside of the bushings advantageously permits two motor driven puller mechanisms 201, 221 to the feeding assembly 200 instead of a single puller mechanism utilized in the prior art. The addition of a second puller mechanism insures a linear feed of the carpet through the sewing assembly 100 regardless of the thickness of the carpet and mitigates the tendency of the carpet 12 to pull away from the machine 10 (or the machine to pull away from the carpet) as the machine 10 is progresses along the edge 11 of the carpet 12 to sew the binding material 14 to overlie the carpet edge 11.

The sewing assembly 100 includes a sewing needle 102 for introducing a needle thread 103, a binder guide 104 for introducing binding material 14, and a looper 106 (shown in FIG. 1 and FIG. 7) for introducing a looper thread 107. The threads 103, 107 are supplied via a needle thread spool 122 and a looper thread spool 124, respectively (see FIG. 1).

As can be seen in FIG. 1, the sewing needle 102 is connected to a reciprocating rod 108 mounted in an extending arm portion 24 of the housing 20. The rod 108 effects upward and downward movement of the needle 102. Reciprocal motion of the rod 108 is driven and controlled by a lever and connecting rod assembly (not shown) driven by the drive mechanism 40. In operation, one revolution of the drive mechanism 40 effects a full upward and downward stroke, or cycle, of the sewing needle 102.

In operation, as the carpet 12 is advanced by the carpet feeding assembly 200 (partially shown in FIGS. 2, 3, and 4), the sewing assembly 100 operates to stitch the binding material 14 simultaneously to a top 15 and a bottom 16 of the piece of carpet 12 by what is known in the art as a type 401 double locked chain stitch.

The carpet feeding assembly 200 includes the two coacting puller mechanisms, generally indicated as reference characters 201 and 221 and a feed-dog 240, which operate in synchronized movement to feed the piece of carpet 12 relative to the sewing assembly 100.

The presence of two coacting puller mechanisms 201 and 221 provide significant advantages over the single puller mechanism of the prior art. Both puller mechanisms 201 and 221 act cooperatively with one another and the feed-dog 240 to pull the carpet 12 through the sewing assembly 100. One of the advantages of having two puller mechanisms 201 and 221 is that the carpet can be more easily fed through the sewing assembly 100, reducing the number of malformed stitches. The operator also expends less energy making said operator more productive during the sewing operation. Yet another benefit is the reduction in stress on the components of the feeding assembly, resulting in a decrease in breakdowns, loosening of detail connections, and a reduction in the number of service calls.

FIG. 4 shows the lower coacting puller mechanism 201. The puller mechanism 201 includes a bottom-mounted or lower motor-driven feed roller 203 with a helical profile 214, a rocker shaft 204, and a rocker arm 211 comprising a cam follower path 213. Mounted on the extending upper arm 24 of the housing 20 is a presser roller 202. The presser roller 202 is biased downwardly, via a spring 205, against the upper surface 15 of the carpet 12. The carpet 12 is firmly gripped or engaged between the upper presser roller 202 and the bottom-mounted feed roller 203. The lower feed roller 203 is downstream, that is, the direction D in FIG. 2, of the feed-dog 240 and the upper puller mechanism 221 and it rotates in synchronization with movement of the feed-dog 240 and rotation of the upper puller mechanism 221 to feed the carpet 12 through the sewing assembly 100, which is fed by rotation of the lower feed roller 203.

As the lower feed roller 203 rotates, the presser roller 202 rotates in a direction opposite the lower feed roller 203, and both rollers in a coacting fashion pull the carpet 12 through the sewing assembly 100. A presser roller adjusting mechanism 206 maintains a predetermined amount of down force on the presser roller 202.

The lower feed roller 203 is fixedly attached to a rocker shaft 204 and comprises a helical profile 214. The rocker shaft is supported near its front 207 and rear 208 by bushings 209 and 210 respectively. The motor driven roller 203 is intermittently rotated by the rocker arm 211. When viewed in FIG. 5B, the counterclockwise rotation of the first eccentric cam 43 generates both clockwise and counterclockwise rotation of the rocker arm 211. The uni-directional clutch 212 is fixedly attached to the rocker arm 211, which engages the rocker shaft 204 when rotated counterclockwise and disengages the rocker shaft when rotated clockwise, as depicted by the arrows in FIG. 5B.

Rocker arm 211 comprises a cam follower 213 that engages the first eccentric cam 43. The clockwise and counterclockwise rotation of the rocker arm 211 is a result of the profile of the first eccentric cam 43 and the configuration of the cam follower 213. Modification of the first eccentric cam 43 or the cam follower 213 will change the amount of rotation resulting in the rocker arm 211. Because of the uni-directional clutch 212, the rocker shaft 204 is intermittently rotated in a counterclockwise direction as described above. The bottom mounted roller 203 is fixedly attached to the rocker shaft 204, which also rotates intermittently in a counterclockwise direction. The counterclockwise rotation of the lower feed roller 203 pulls the carpet 12 by engaging the carpet bottom 16. Facilitation of the pulling process occurs through the synchronized rotation of the lower feed roller 203 and the clockwise rotation of the presser roller 202, on the carpet 12 therebetween. The presser roller 202 engages the top portion 15 of the carpet 12. The spring 205 asserts an axial force downward through the presser roller 202 onto the carpet 12, thereby ensuring the engagement of both the presser roller and the lower feed roller 203 to the carpet as its pulled through the sewing assembly 100. The amount of axial downward force can be varied through a presser roller adjusting mechanism 206.

As can best be seen in FIG. 4, the lower feed roller 203 and the top mounted presser roller 202 include a helical profile or outer surface 214 and 217, respectively. The exemplarily embodiment shows the helical profile of 214 to resemble a left-handed thread configuration and helical profile 217 comprises a right-handed configuration. This forces the carpet 12 to be drawn inward, that is, in the direction I in FIGS. 3 and 4, relative to the carpet feeding assembly 200 because of the axially-transverse thrust generated by the left-handed helical profile 214, and the counterclockwise rotation of the bottom mounted motor driven roller 203 along with the axially-transverse thrust generated by the right-handed helical profile 217, and the clockwise rotation of the top mounted presser roller 202. The helical profiles then reduce the amount of effort required by the operators during the sewing process, since the carpet 12 has a tendency to pull away from the sewing assembly 100 during sewing as the machine 10 moves along the carpet edge 11. The feed roller profiles used by the prior art resemble a spur or spline configuration, which exacerbates the carpet's tendency to pull away from the machine, because of such profiles inherent lack of resistance. In addition, the prior art lacks the axially transverse thrust generated by the described invention. The helical profiles 214 and 217 can also contain breaks in the threads resembling crenellated rows or teeth along a left-hand or right-handed thread path.

The coacting puller mechanisms 201 and 221 are not only designed to achieve proper kinematic motion, but also to operate harmoniously with other linkages, levers, cams, shafts, and followers within a limited amount of space defined by the housing 20. The described invention makes best use of the limited space through the unique designs of the rocker arm 211, uni-directional clutch 212, cam follower 213, and first eccentric cam 43 located between the internal housing flange 21, as shown in FIG. 4, and the feed-dog 240 and lifter 241 shown in FIG. 3.

The design of the present invention advantageously provides a ⅜ inch cavity to accommodate the location of the rocker arm 211 and the first eccentric cam 43. The design was accomplished without the need of any additional linkages or universal joints. The present invention maintains the configuration of the feed-dog 240 and feed-dog lifter 241 disclosed in the '723 patent. This reduces the cost of production by using standard components. Yet another advantage of the present invention is that it incorporates a direct drive between the second eccentric cam 44 and feed-dog lifter 241, thus preventing any loss of motion that would occur through the use of additional linkages or universal joints.

Relocating coacting puller mechanism 201 toward the front F of the housing 20 not only permits a single piece drive mechanism 40, but also enables the addition of the second upper coacting puller mechanism 221 to the mid-section 54 of the single piece drive mechanism 40, as shown in FIGS. 3 and 4. The upper coacting puller mechanism further reduces the amount of effort expended by the operator during a sewing operation, since the carpet 12 can now be more easily fed through the sewing assembly 100. As well, there is a reduction in the opposing forces on the components of the puller mechanisms, thereby making the details less susceptible to breaking or working loose. In addition, the second motor driven puller mechanism 221 reduces carpet slippage and the malformed stitches, which would result from such slippage.

Figure 5A:
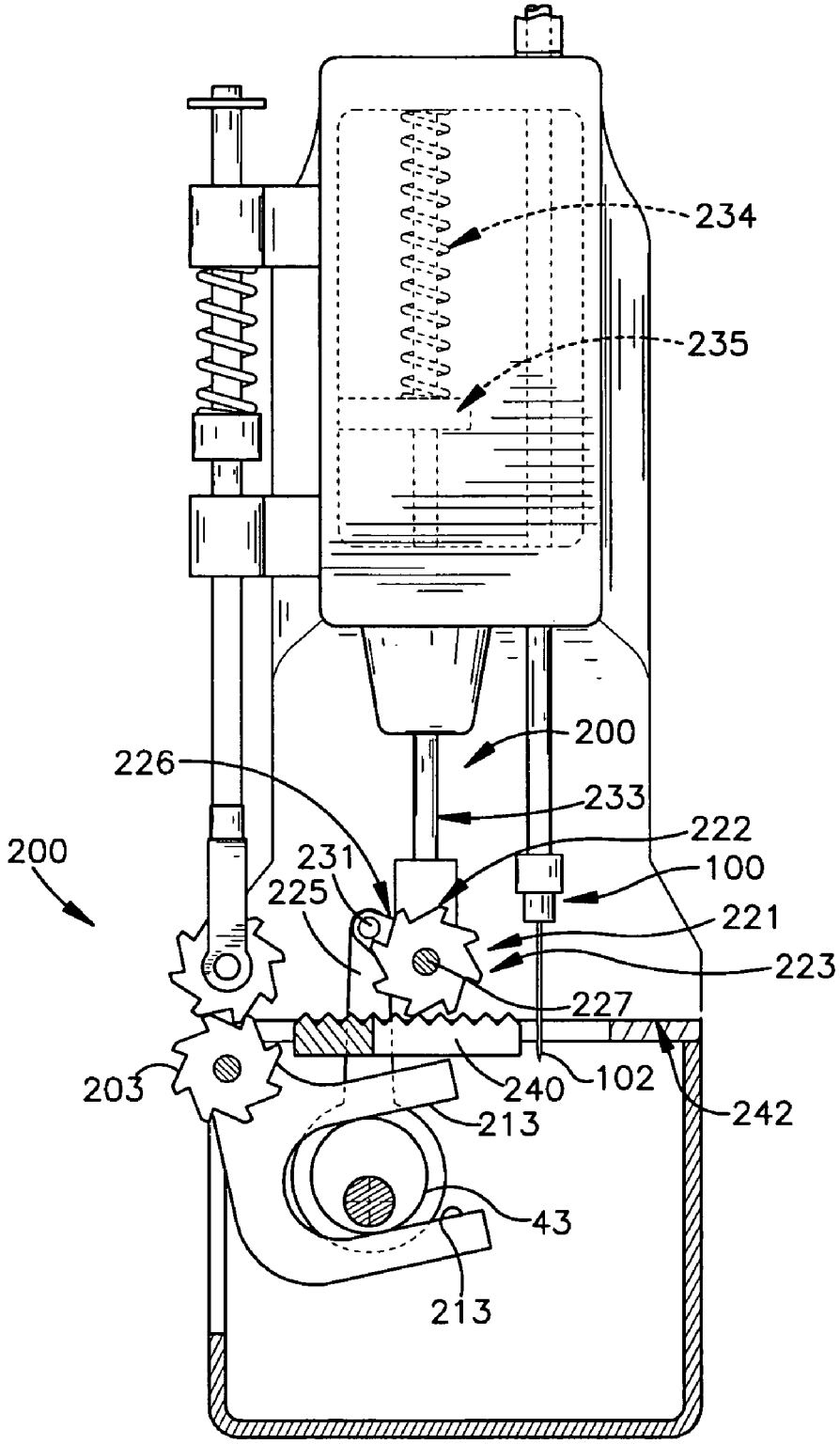
FIG. 5A is a front view, partly in section and partly in elevation, of the portable carpet binding machine of FIG. 1 showing a rocker arm that drives the lower feed roller.
Figure 5B:
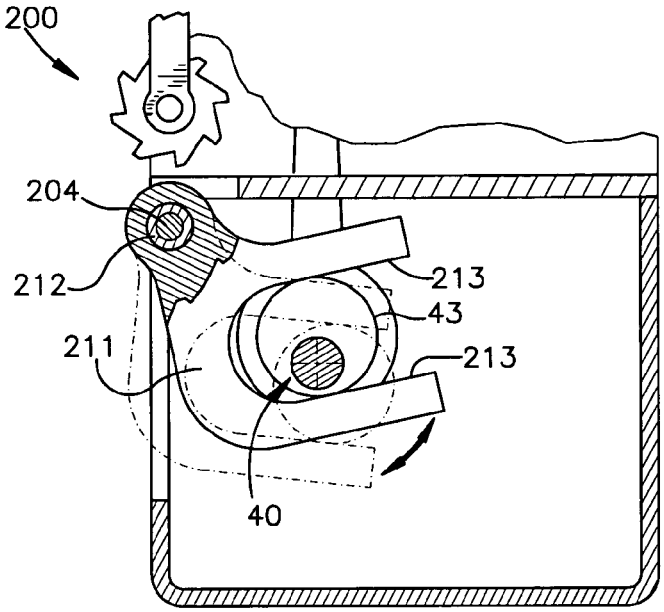
FIG. 5B is a front view, partly in section and partly in elevation, of the portable carpet binding machine of FIG. 1 showing a unidirectional clutch and a rocker arm that drives the lower feed roller shaft.
Figure 5C:
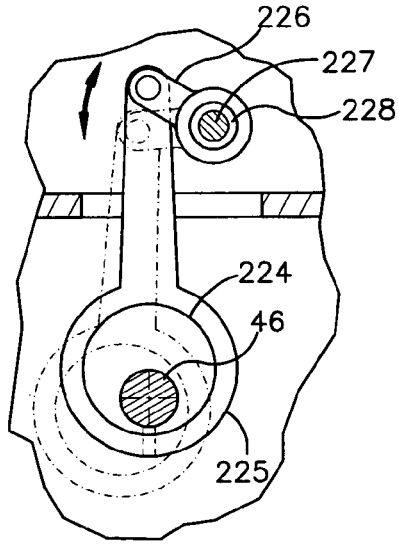
FIG. 5C is a sectional view of the portable carpet binding machine of FIG. 1 showing the drive mechanism for the upper feed roller.

Referring more closely to FIGS. 3, 5A, and 5C the upper coacting puller mechanism 221 comprises an eccentric cam 224, a connecting rod 225, rocker arm 226, a housing 222, and an upper motor-driven feed roller 223 with a helical profile 232. The upper coacting puller mechanism 221 works in synchronization with the feed-dog 240 and the lower puller mechanism 201. The eccentric cam 224 is fixedly attached to single piece shaft 46 between front bushing 51 and rear bushing 52. As can be seen in FIG. 6A, a flat region 45 near a center of the shaft 46 is adapted to be engaged by a set screw which fixes the cam 224 in place with respect to the shaft. Driven by the profile of the eccentric cam 224 is the connecting rod 225, which translates about the drive shaft 46. The connecting rod 225 is rotatably connected to the rocker arm 226 via pin 231. The translation in the connecting rod 225 forces the rocker arm 226 to rotate in both a clockwise and counterclockwise direction. The rotation of the rocker arm 226 creates a ratcheting effect on the upper rocker shaft 227. This allows intermittent rotation of the rocker shaft in a clockwise direction as viewed from FIG. 5A, while remaining idle when the rocker arm 226 is rotated in a counterclockwise direction. The rocker shaft 227 is supported by bushings 229 and 230 press fit within the roller housing 222. The ratcheting effect on the rocker shaft 227 is accomplished through a uni-directional clutch 228 fixedly attached to the rocker shaft 227.

Figure 2:
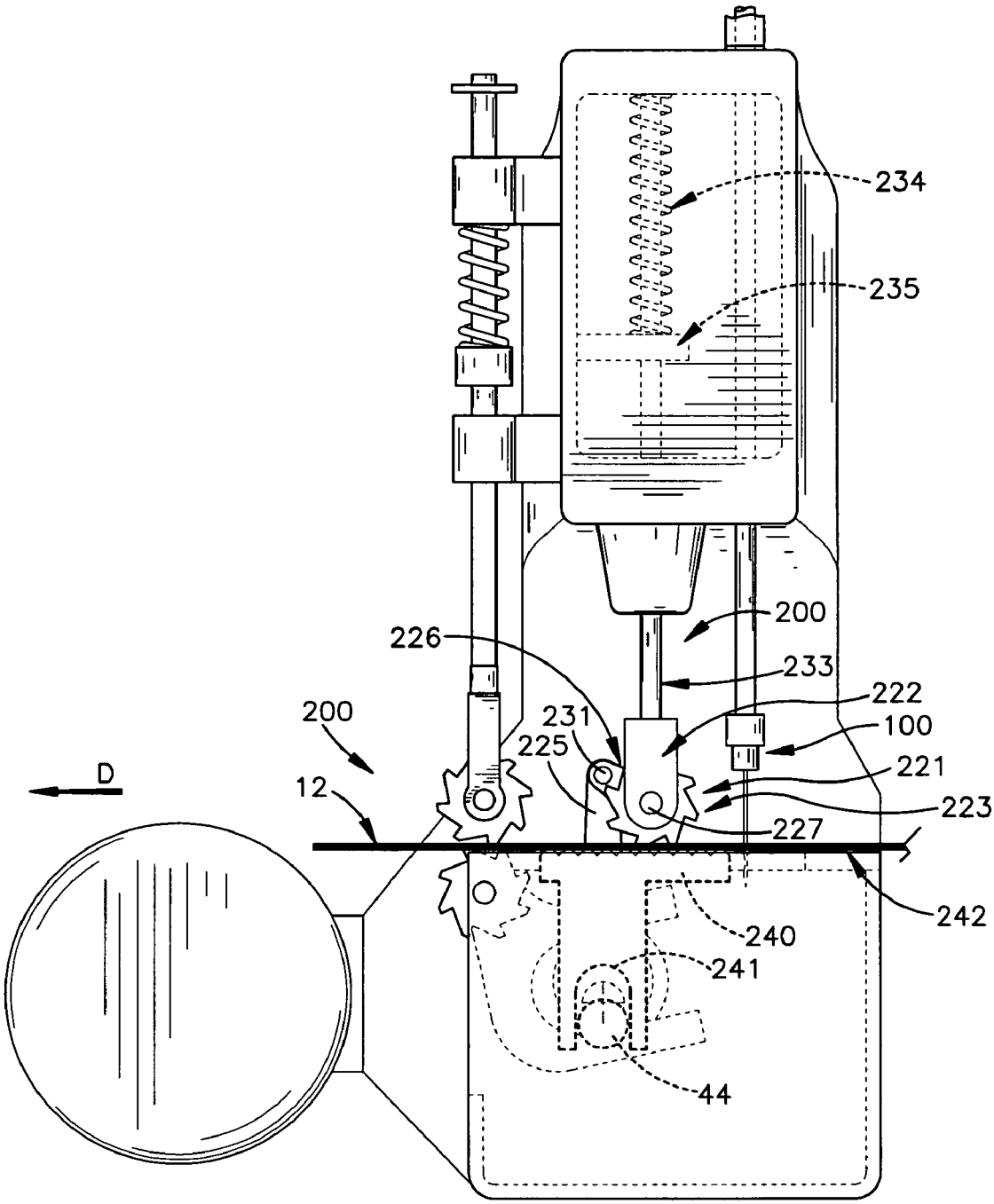
FIG. 2 is a front elevation view of the portable carpet binding machine of FIG. 1 showing upper and lower feed rollers.

In order to accommodate varying thicknesses of the carpet material the upper motor driven roller 223 must be capable of vertical movement, while at the same time able to rotate pulling the carpet 12 through the sewing assembly 100. As best can be seen in FIGS. 2 and 3, relative vertical movement of the straight shaft 227 and the drive shaft 46 is provided by the pivotal connection between the connecting rod 225 and rocker arm 226. As the straight shaft 227 moves vertical with respect to the drive shaft 46 and a throat plate 242 of the feed-dog 240, the shaft 227 remains parallel to the drive shaft 46. This eliminates the use of universal joints and linkages that are typically required to obtain this dual acting motion. The current invention allows for both rotation and translation through the use of only the straight shaft 227 and rocker arm 226. Manual vertical movement of the upper feed roller 223 is also permitted by a manually activated lever that is coupled to a roller rod 233 and the roller housing 222.

The rotation of the upper feed roller 223 occurs once per sewing cycle, where one revolution of the drive shaft 46 causes an oval-type movement the feed-dog 240 and a clockwise rotation of the top-mounted motor driven roller 223 to act in concert to engage and pull the carpet 12 through the sewing assembly 100. The feed-dog 240 operates to engage the bottom 16 of the piece of carpet 12 through the lifter 241, which is driven by the second eccentric cam 44 located on the drive shaft 46. The second eccentric cam 44 and the lifter together control the rise and fall of the feed-dog 240. The feed-dog 240 moves in both the horizontal and vertical directions in a generally oval path. When the feed-dog 240 rises above an upper surface of the feed-dog throat plate 242 (FIGS. 1 & 5A) and engages the bottom surface 16 of the carpet 12, it then moves generally horizontally in the downstream direction D to move the carpet 12 in the downstream direction D. The length of the path of travel of the feed-dog 240 in the downstream direction D while above the throat plate 242 will determine the length of each stitch. At the same time the feed-dog 240 is moving above the throat plate 242 in the direction D, the upper feed roller 223 rotates in a clockwise direction CW (as seen in FIG. 2) and the lower feed roller 203 rotates in a counterclockwise direction CCW (again, as seen in FIG. 2) in appropriate rotational amounts to match the linear distance the feed-dog 240 moves the carpet 12 downstream D. To complete its oval path, the feed-dog 240 at the end of path of travel downstream D falls vertically below the throat plate 242 (out of contact with the carpet 12) and moves horizontally upstream (opposite the direction D) while remaining below the throat plate 242.

The top mounted motor driven roller 223 also comprises a helical profile 232 that resembles a right-handed thread configuration. The carpet 12 is then drawn inward direction I (see FIGS. 3 and 4) relative to the carpet feeding assembly 200 because of the axially-transverse thrust generated by the right-handed helical profile and the clockwise rotation of the top mounted motor driven roller 223.

The helical profile in the top mounted motor driven roller 223 like that in the bottom mounted motor driven roller 203 reduces the amount of effort expended by the operators during the sewing process, since the carpet 12 has a natural tendency to pull away from the sewing assembly 100. There exists a natural tendency to pull away because, inter alia, the majority of the carpet's weight is outside of the feeding assembly 200. The helical profile as discussed above can comprise any number of different configurations, including continuous threads, or crenellated rows or teeth along a left-hand or right-handed thread path.

A predetermined amount of downward force is applied to the carpet 12 through the top-mounted feed roller 223 by way of the housing 222 and the roller rod 233. The amount of down force applied to the roller rod can be varied by changing the location of an adjustment mechanism 235 relative to a spring 234. The amount of axial down force varies the force of engagement between the upper feed roller 223 and the feed-dog 240 with the carpet 12 when the feed-dog 240 is in an upward position, that is engaged and moving the carpet in the downstream direction D. When the feed-dog 240 is not in its upward position, that is, the feed-dog is recessed below openings in a feed-dog throat plate 242, the carpet 12 is engaged between the throat plate 242 and the upper feed roller 223. The axial down force also acts in conjunction with the helical profile 232 to force the carpet 12 down and inwardly (in the direction I) as it moves through the sewing assembly 100, opposed to the natural tendency to pull up and away from the housing 20. This again reduces the amount of energy required by the operator in using the carpet-binding machine 10.

Figure 7A:
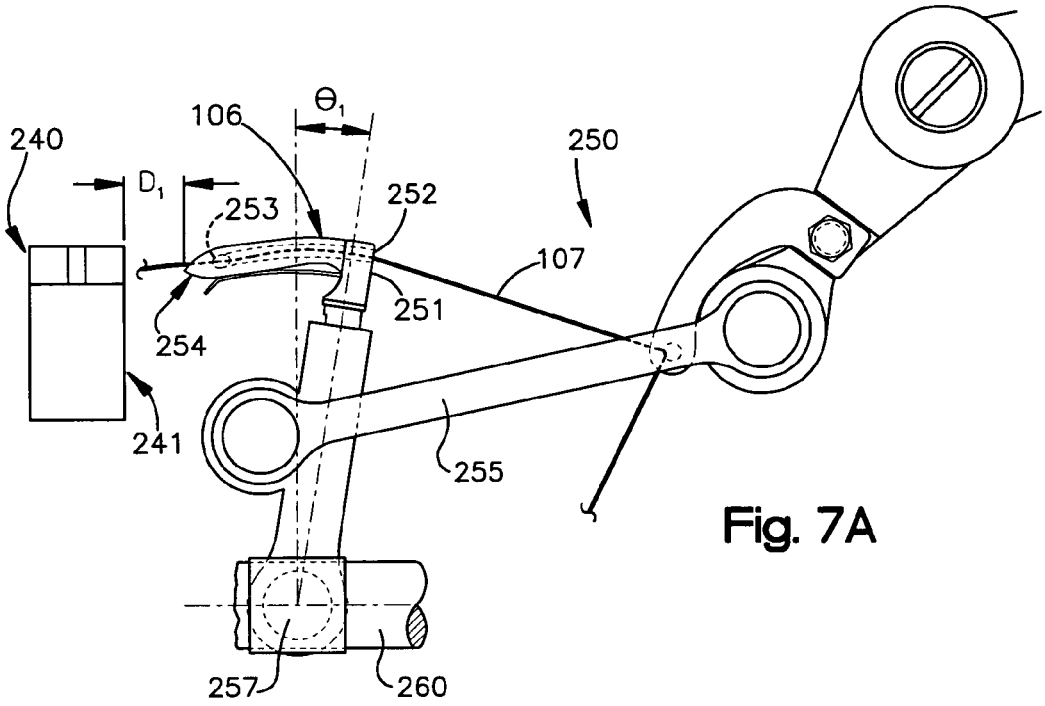
FIG. 7A is an elevation view of a looper drive mechanism of the portable carpet binding machine found in the prior art in a first position.
Figure 7B:
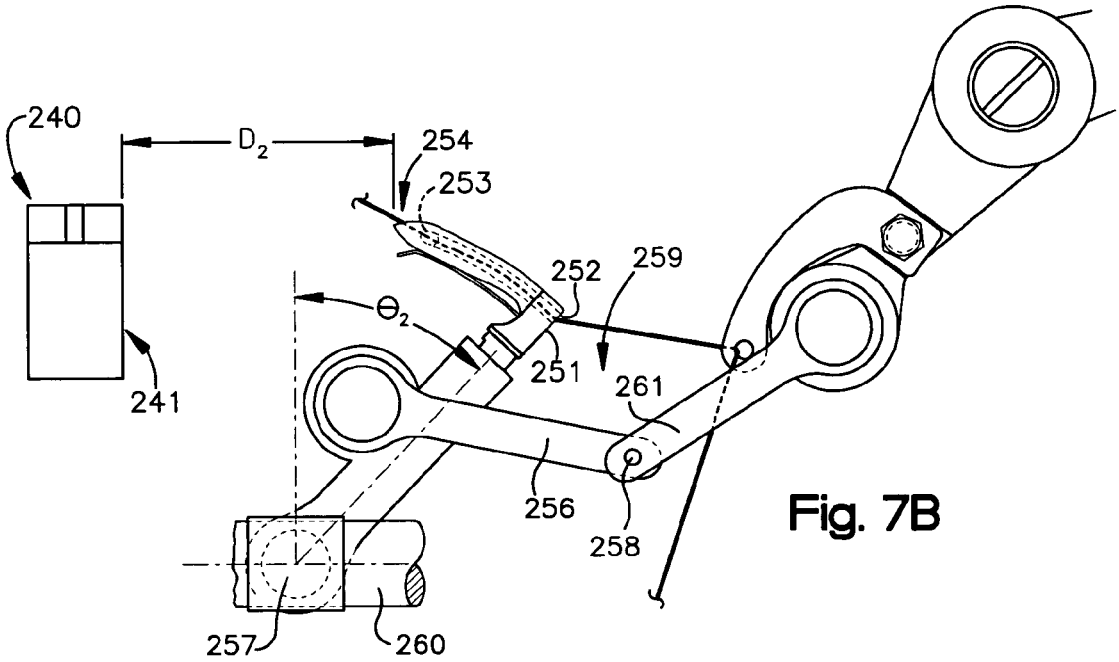
FIG. 7B is an elevation view of the looper drive mechanism of the portable carpet binding machine of FIG. 1 in a second position.

Another enhancement of the present invention is shown in FIGS. 1 and 7B, which is a retractable linkage in the looper assembly 250. The looper 106 uses looper thread 107 in making among others, a type 401 double locked chain stitch as discussed above. One of the inherent problems in any sewing operation is rethreading the looper when the looper thread 107 runs-out or breaks during operation. Rethreading the looper requires significant time as the looper thread 107 must be hand fed through a first aperture 252 located at the heel 251 of the looper up through a second aperture 253 located in the front 254 portion of the looper 106. The significant amount of time to rethread the looper is a result of the close proximity of the feed-dog 240 and the lifter 241 to the front portion 254 of the looper represented by distance D1 in FIG. 7A. FIG. 7A also shows prior art's looper 106 in its most retracted position, since a connecting rod 255 in the prior art comprises a continuous link. Thus, the prior art shown in FIG. 7A is the looper's most retracted position hereinafter referred to as Position 1, which limits the looper to a rotation of an angle $\ominus$1 about pin 257 on a rocker shaft 260.

To significantly reduce the amount of time required to rethread the looper 106, the described embodiment modifies the connecting rod 255 into a two-piece linkage assembly 259, as shown in FIG. 7B. The two-piece linkage assembly 259 comprises a first link 256 rotatably connected to a second link 261 through connection pin 258. The two-piece linkage assembly allows the looper 106 to rotate to an angle $\ominus$2 about pin 257 on the rocker shaft 260, hereinafter referred to as Position 2. The distance between the feed-dog 240 and lifter 241 to the front of the looper 254 is represented by distance D2 in FIG. 7B.

The new design's increase in retraction shown by distance D2 and angle $\ominus$2 in Position 2 is more than twice that of D1 and $\ominus$1 respectively. This increase in retraction resulting from the linkage assembly's design is an important advantage over the prior art, which will reduce the amount of time and effort required in rethreading the looper after thread run-outs or breaks during operation.

Although the present invention has been described with a certain degree of particularity, it should be understood that those skilled in the art can make various changes to it without departing from the spirit or scope of the invention as hereinafter claimed.

The invention claimed is:

1. A portable carpet binding machine comprising:

a) a housing defining an interior region;

b) a drive mechanism supported by the housing and at least partially disposed in the interior region;

c) a prime mover operatively coupled to the drive mechanism for providing motive power to the drive mechanism;

d) a sewing assembly driven via the drive mechanism for sewing a strip of material to a piece of carpet; and e) a carpet feeding assembly including a feed driver mechanism and a coacting puller mechanism operating in substantially synchronous movement to linearly feed the piece of carpet relative to the sewing assembly; the feed driver mechanism including a feed-dog driven by the drive mechanism that intermittently engages a lower surface of the piece of carpet to thereby advance the piece of carpet forward; the coacting puller mechanism including a first feed roller being independently driven and engaging an upper surface of the piece of carpet and a second feed roller engaging the lower surface of the piece of carpet, the first and second feed rollers being driven by the drive mechanism to pull the piece of carpet forward substantially simultaneously with respect to advancement of the carpet by the feed-dog of the feed driver mechanism.

2. The portable carpet binding machine of claim 1 wherein the first roller of the coacting puller mechanism is disposed above the feed-dog and provides a downward force so that the piece of carpet is engaged between the feed-dog and the first roller during advancement of the carpet.

3. The portable carpet binding machine of claim 1 wherein the second feed roller of the coacting puller mechanism is disposed downstream of the feed-dog.

4. The portable carpet binding machine of claim 3 wherein the coacting puller mechanism includes a presser roller for providing a downward force opposite the second feed roller so that the piece of carpet is engaged therebetween.

5. The portable carpet binding machine of claim 1 wherein the coacting puller mechanism further includes a first clutch being operatively connected to the first feed roller for providing intermittent rotation to the first feed roller.

6. The portable carpet binding machine of claim 5 wherein the drive mechanism includes a first shaft and the first feed roller is fixedly attached to the first shaft and the first clutch is rotatably affixed to the first shaft.

7. The portable carpet binding machine of claim 6 wherein coacting puller mechanism further includes an eccentric cam fixedly attached to the drive mechanism, whereby a connecting rod is driven by the eccentric cam, forcing the connecting rod to translate in a first and second direction, wherein said connecting rod is rotatably connected to a rocker arm and driven by the connecting rod in reciprocating arcuate motion, said first clutch is fixedly attached to said rocker arm and rotation of the clutch in the first direction rotates the first feed roller and rotation of the clutch in the second direction provides no rotation of the first feed roller.

8. The portable carpet binding machine of claim 1 wherein the coacting puller mechanism further includes a clutch being operatively connected to the second feed roller for providing intermittent rotation to the second feed roller.

9. The portable carpet binding machine of claim 8 wherein the drive mechanism includes a shaft and the second feed roller is fixedly attached to the shaft and said clutch is rotatably affixed to the shaft.

10. The portable carpet binding machine of claim 9 wherein the coacting puller mechanism further includes a rocker arm having a cam follower following an eccentric cam attached to the drive mechanism drive shaft, a base portion of the rocker arm being fixedly attached to the clutch such that rotation of the drive shaft rotates the eccentric cam, the rotation of the eccentric cam moving the rocker arm in a reciprocating arcuate motion and causing the base of the rocker arm to rotate the clutch between respective first and second directions, whereby rotation of the clutch in the first direction rotates the second feed roller and rotation of the clutch in the second direction provides no rotation of the second feed roller.

11. The portable carpet binding machine of claim 1 wherein the sewing assembly includes a binder guide, a sewing needle and a looper; the binder guide operating to fold the strip of material around an edge portion of the piece of carpet, a first piece of thread being threaded through an aperture of the needle and a second piece of thread being threaded through an aperture of the looper, the sewing assembly when driven operating to stitch the strip of material to opposite sides of the edge portion of the piece of carpet using the first and second pieces of thread.

12. The portable carpet binding machine of claim 1 wherein the sewing assembly operates to sew the binding material to the opposite sides of the edge portion of the piece of carpet using a double locked chain stitch.

13. The portable carpet binding machine of claim 1 wherein the housing includes a feed-dog throat plate defining an opening through which the feed-dog partially extends when the feed-dog engages the lower surface of the piece of carpet to advance the piece of carpet, the first roller of the coacting puller mechanism urging the piece of carpet against the feed-dog throat plate.

14. The portable carpet binding machine of claim 1 wherein said first and second feed rollers include a helical outer surface producing a force that pulls the carpet inward relative to the sewing assembly.

15. The portable carpet binding machine of claim 1, wherein said feed driver mechanism and coacting puller mechanism are driven by a single piece drive shaft having a first and second cam integral to said shaft, whereby said first cam drives said coacting puller mechanism and said second cam drives said feed driver mechanism.

16. A binding machine comprising:

a) a housing defining an interior region;

b) a drive mechanism supported by the housing and at least partially disposed in the interior region, the drive mechanism including a single piece drive shaft;

c) a prime mover operatively coupled to the drive mechanism for providing motive power to the drive mechanism;

d) a sewing assembly driven via the drive mechanism for stitching a binding material to an edge of a base material; and e) a material feeding assembly driven via the drive mechanism including a feed driver mechanism and a coacting puller mechanism operating in substantially synchronous movement to linearly feed the base material relative to the sewing assembly; the feed driver mechanism including a feed-dog driven via the drive mechanism that intermittently engages a lower surface of the base material to thereby advance the base material forward; the coacting puller mechanism including a first feed roller mounted on a shaft and engaging an upper surface of the base material and being driven by the drive mechanism to pull the base material forward substantially simultaneously with respect to advancement of the base material by the feed-dog of the feed driver mechanism, the first feed roller being disposed above the feed-dog and remains substantially in time with said feed-dog independent of said base material thickness, the first feed roller providing a downward force so that the base material is engaged between the feed-dog and the first feed roller during advancement of the base material, the first feed roller drive shaft driven by the drive mechanism single piece drive shaft wherein the first feed roller drive shaft is substantially parallel to the single piece drive shaft.

17. The binding machine of claim 16 wherein the base material is carpeting and the binding material is stitched to overlie an edge of the carpeting.

18. The binding machine of claim 16 wherein the coacting puller mechanism includes a second feed roller engaging the lower surface of the base material and being driven by the drive mechanism to pull the base material forward substantially simultaneously with respect to advancement of the carpet by the feed-dog of the feed driver mechanism and the first feed roller.

19. The binding machine of claim 18 wherein the second feed roller of the coacting puller mechanism is disposed downstream of the feed-dog.

20. The binding machine of claim 19 wherein the coacting puller mechanism includes a presser roller for providing a downward force opposite the second feed roller so that the base material is engaged therebetween.

21. The binding machine of claim 18 wherein the coacting puller mechanism further includes a clutch being operatively connected to the second feed roller for providing intermittent rotation to the second feed roller.

22. The binding machine of claim 21 wherein the drive mechanism includes a shaft and the second feed roller is fixedly attached to the shaft and the clutch is rotatably affixed to the shaft.

23. The binding machine of claim 22 wherein the coacting puller mechanism further includes a puller link and rocker arm, the puller link being rotatably connected to an eccentric cam fixedly attached to the drive mechanism shaft, the rocker arm being fixedly attached to the clutch and pivotally connected relative to the puller link such that rotation of the shaft intermittently pushes and pulls the link, the push-pull motion being translated via the rocker arm to rotate the clutch between respective first and second directions, whereby rotation of the clutch in the first direction rotates the second feed roller and rotation of the clutch in the second direction provides no motion to the second feed roller.

24. The portable binding machine of claim 18 wherein said first and second feed rollers include a helical outer surface producing a force that pulls the carpet inward relative to the sewing assembly.

25. The binding machine of claim 16 wherein the coacting puller mechanism further includes a first clutch being operatively connected to the first feed roller for providing intermittent rotation to the first feed roller.

26. The binding machine of claim 25 wherein the drive mechanism includes a first shaft and the first feed roller is fixedly attached to the first shaft and the first clutch is rotatably affixed to the first shaft.

27. The binding machine of claim 26 wherein the coacting puller mechanism further includes a rocker arm having extending arms enveloping an eccentric cam fixedly attached to the drive mechanism first shaft, a base portion of the rocker arm being fixedly attached to the clutch such that rotation of the first shaft rotates the eccentric cam, the rotation of the eccentric cam moving the arms of the rocker arm in a reciprocating arcuate motion and causing the base of the rocker arm to rotate the clutch between respective first and second directions, whereby rotation of the clutch in the first direction rotates the first feed roller and rotation of the clutch in the second direction provides no motion to the first feed roller.

28. The binding machine of claim 16, wherein said single piece drive shaft having a first and second cam integral to said shaft, whereby said first cam drives said coacting puller mechanism and said second cam drives said feed driver mechanism.

29. A binding machine comprising:

a) a housing defining an interior region;

b) a drive mechanism supported by the housing and at least partially disposed in the interior region having a single piece drive shaft, including a first and second eccentric cam integral to said shaft;

c) a sewing assembly driven via the drive mechanism for sewing a first material to a second material; and d) a material feeding assembly including a coacting puller mechanism and a feed driver mechanism, both driven by said first and second eccentric cams, respectively, and both operating in substantially synchronous movement to feed the second material relative to the sewing assembly; the feed driver mechanism including a feed-dog driven by the drive mechanism that intermittently engages a lower surface of the second material to thereby advance the second material forward; the coacting puller mechanism including a first feed roller engaging an upper surface of the second material, the first feed roller being driven by the drive mechanism to pull the second material forward substantially simultaneously with respect to advancement of the second material by the feed-dog of the feed driver mechanism.

30. The binding machine of claim 29 wherein the first material is binding material and the second material is carpeting and the binding material is stitched to overlie an edge of the carpeting.

31. The binding machine of claim 29 wherein the coacting puller mechanism includes a second feed roller engaging the lower surface of the second material and is driven via the drive mechanism to pull the second material forward substantially simultaneously with respect to advancement of the second material by the feed-dog of the feed driver mechanism and the first feed roller.

32. The binding machine of claim 31 wherein said first and second feed rollers include a helical outer surface producing a force that pulls the first and second materials inward relative to the sewing assembly.

33. The binding machine of claim 29 wherein the first feed roller of the coacting puller mechanism is disposed above the feed-dog and provides a downward force so that the second material is engaged between the feed-dog and the first roller during advancement of the second material.

34. A binding machine comprising:

a) a housing defining an interior region;

b) a drive mechanism supported by the housing and at least partially disposed in the interior region;

c) a looper assembly comprising a looper, looper thread, a plurality of apertures, and a connecting rod, whereby the connecting rod comprises a plurality of parts; wherein one part of the plurality of parts are links with a pivotal connection between a first and a second link, in the first position of the one link, the looper is positioned for stitching and in the second position of the one link, the looper is retracted for access to the looper for threading.

35. A binding machine comprising a single piece drive mechanism including a shaft having first and second eccentric cams, one of the first and second eccentric cams driving a feed-dog to advance carpet material through a sewing assembly, wherein said single piece drive shaft can be removed from, or inserted into a housing of said binding machine without removing said first and second eccentric cams from said shaft.

36. The binding machine of claim 35 wherein the other of the first and second eccentric cams drives a feed roller.

37. A binding machine comprising a single piece drive mechanism including a shaft having integral first and second eccentric cams, one of the first and second eccentric cams driving a feed-dog to advance carpet material through a sewing assembly, such that the other of the first and second eccentric cams drives a feed roller, wherein a third eccentric cam is removably attached to the shaft, said third eccentric cam driving a second feed roller.

* * * * *